US006908007B2

(12) United States Patent
Hrdlicka

(10) Patent No.: US 6,908,007 B2
(45) Date of Patent: Jun. 21, 2005

(54) PORTABLE PAPER DISPENSER APPARATUS

(76) Inventor: James T. Hrdlicka, 923 W. Saint Benedict Dr., Bismarck, ND (US) 58501

( * ) Notice: Subject to any disclaimer, the term of this patent is extended or adjusted under 35 U.S.C. 154(b) by 179 days.

(21) Appl. No.: 10/462,523

(22) Filed: Jun. 16, 2003

(65) Prior Publication Data

US 2003/0233920 A1 Dec. 25, 2003

Related U.S. Application Data

(60) Provisional application No. 60/390,105, filed on Jun. 21, 2002.

(51) Int. Cl.[7] ..... B65H 1/00
(52) U.S. Cl. ..... 221/33; 242/588.5; 206/409
(58) Field of Search ..... 221/33; 242/588.2, 242/588.3, 588.5; 206/409, 812, 389; 225/103

(56) References Cited

U.S. PATENT DOCUMENTS 4,635,362 A 1/1987 Brown
4,881,675 A 11/1989 Varley, III
5,509,561 A * 4/1996 Kanterovitch ..... 220/4.28
5,593,035 A * 1/1997 Taylor et al. ..... 206/397
6,003,668 A 12/1999 Joyce
6,068,118 A 5/2000 Calloway
6,213,424 B1 4/2001 Helfer-Grand
2001/0052559 A1 * 12/2001 Inana et al. ..... 242/348

* cited by examiner

*Primary Examiner*—Kenneth Noland

(57) ABSTRACT

A portable paper dispenser apparatus is provided for dispensing a layer of paper from a roll of paper and includes a base member. First and second side supports are attached to respective first and second ends of the base member and project upward therefrom. Respective support rod reception means are provided on the respective side supports. A roll support rod is received in the respective support rod reception means. A handle is connected between the respective side supports, above the roll support rod. A paper guide assembly extends from end to end of the base member and is positioned in front of the side supports. A blade guide channel member is attached to the base member and extends from end to end of the base member. The blade guide channel member is positioned below the top surface of the base member and in front of the paper guide assembly.

19 Claims, 6 Drawing Sheets

FIG 1
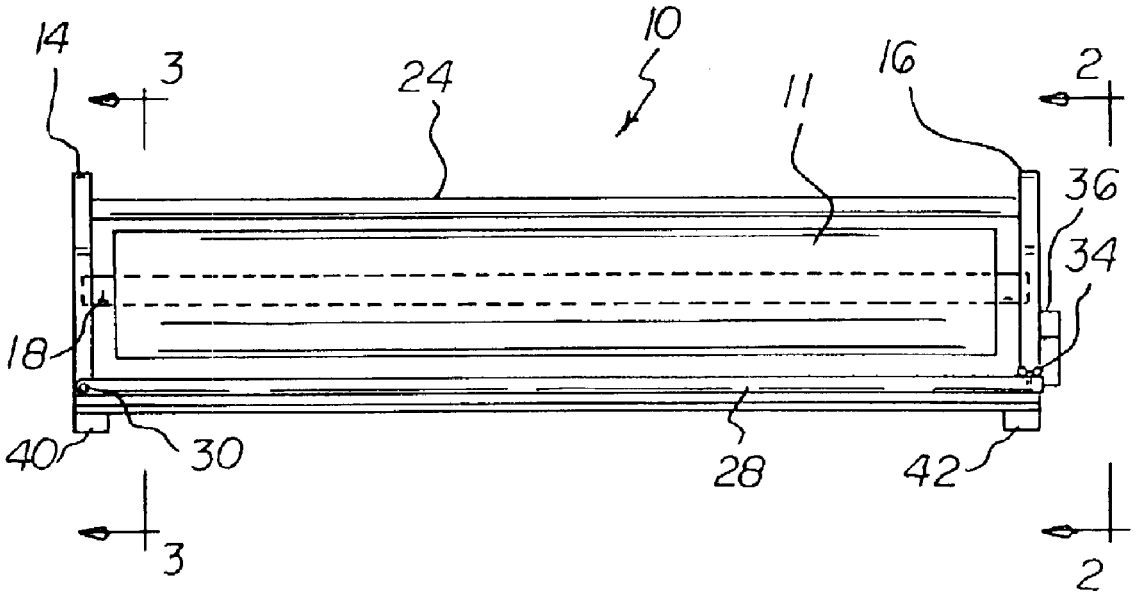
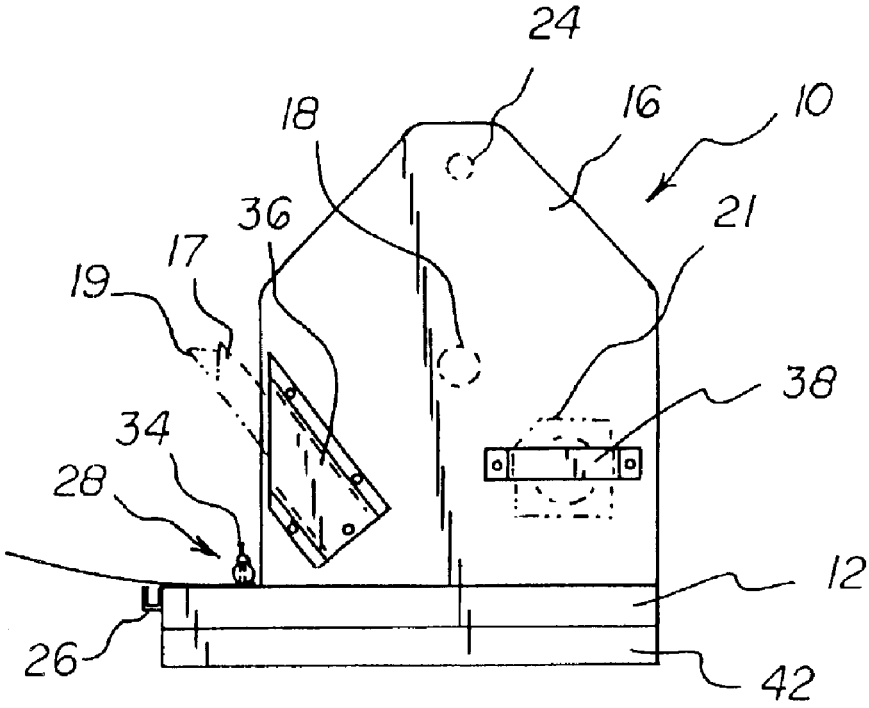
FIG 2

FIG 3
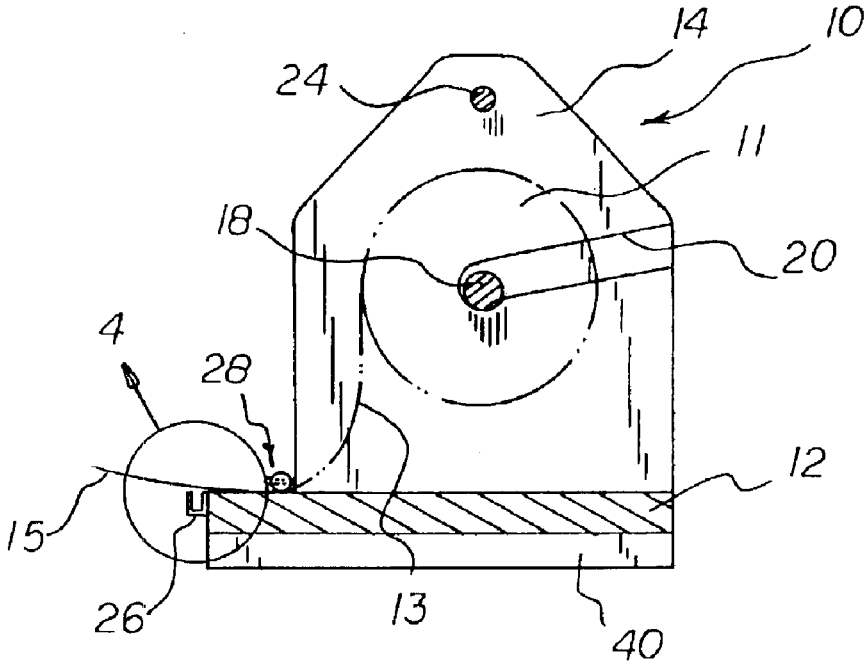
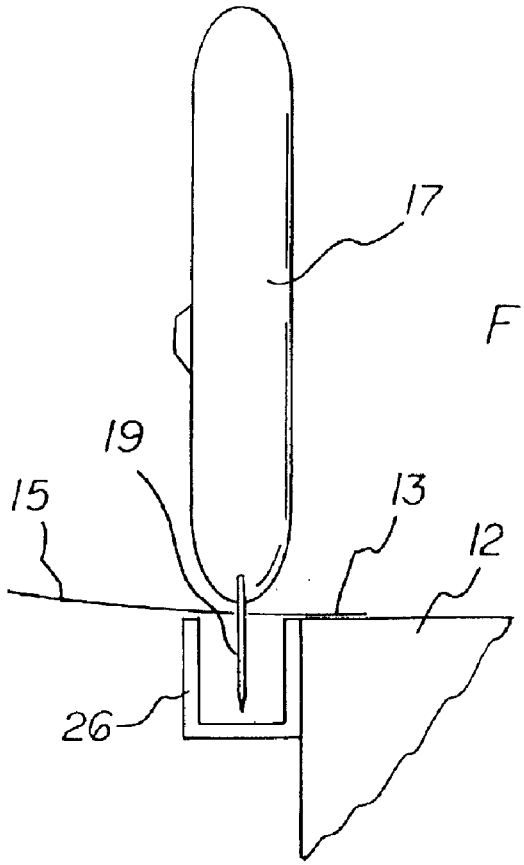
FIG 4

FIG 6
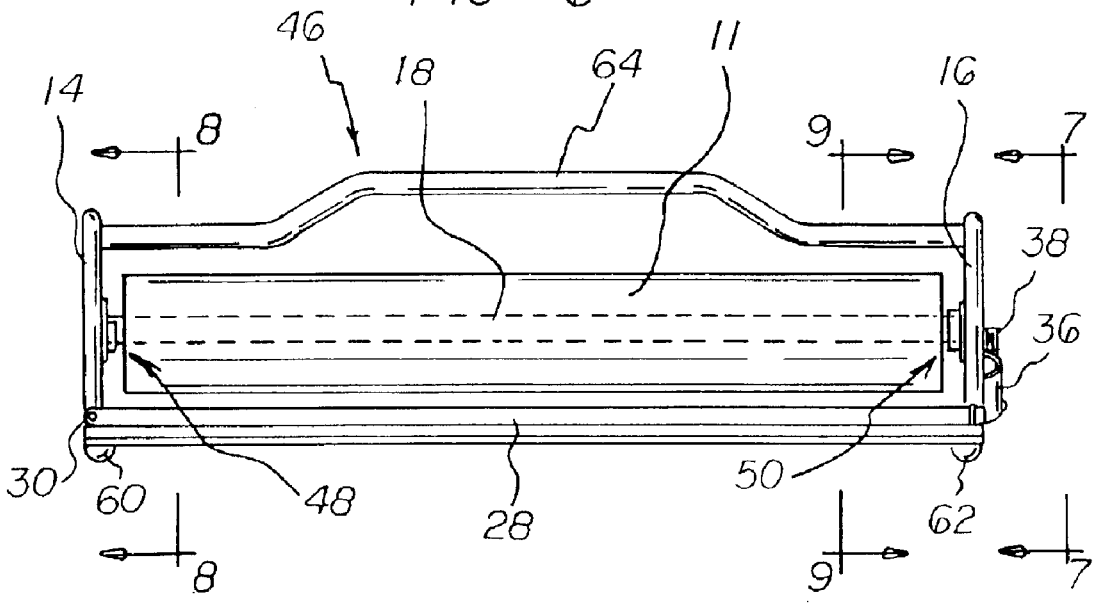
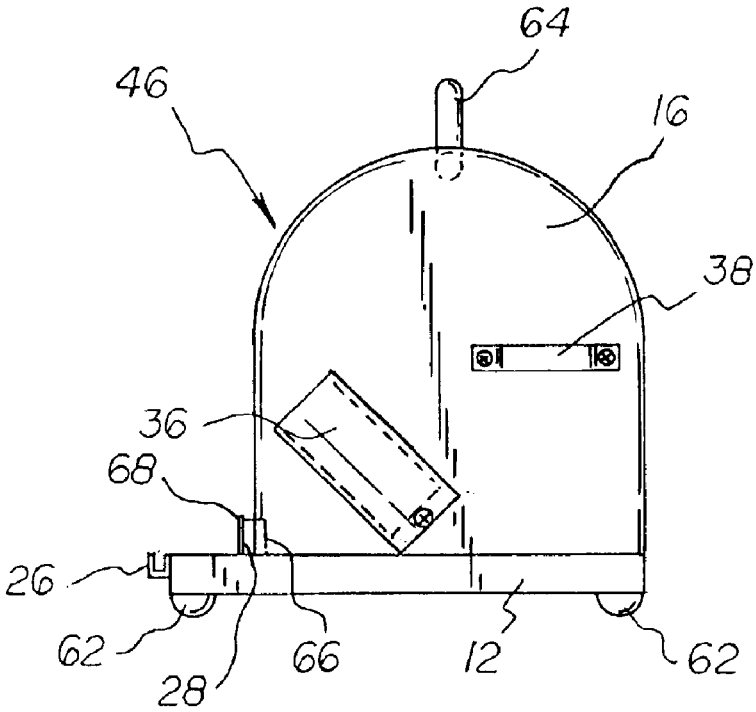
FIG 7

FIG 8
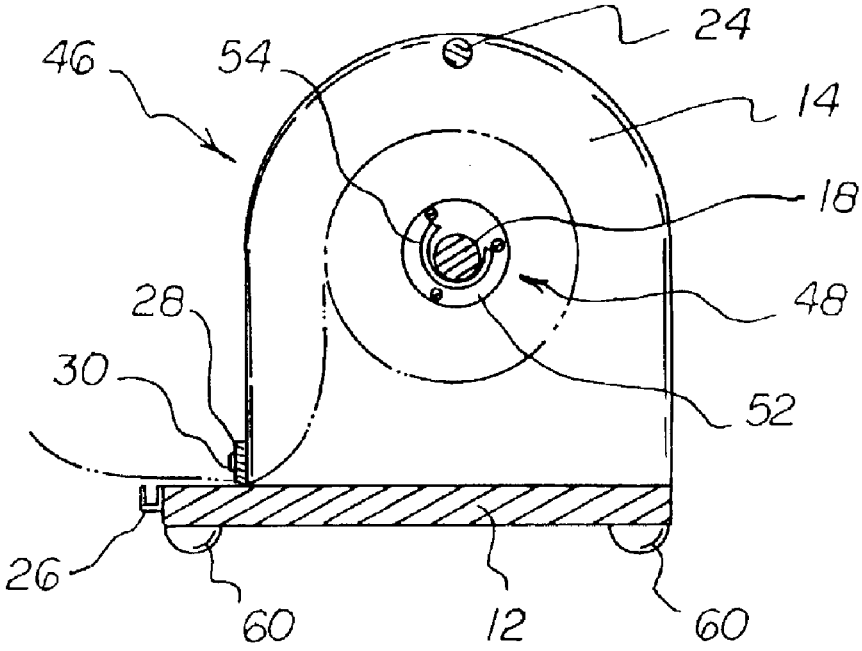
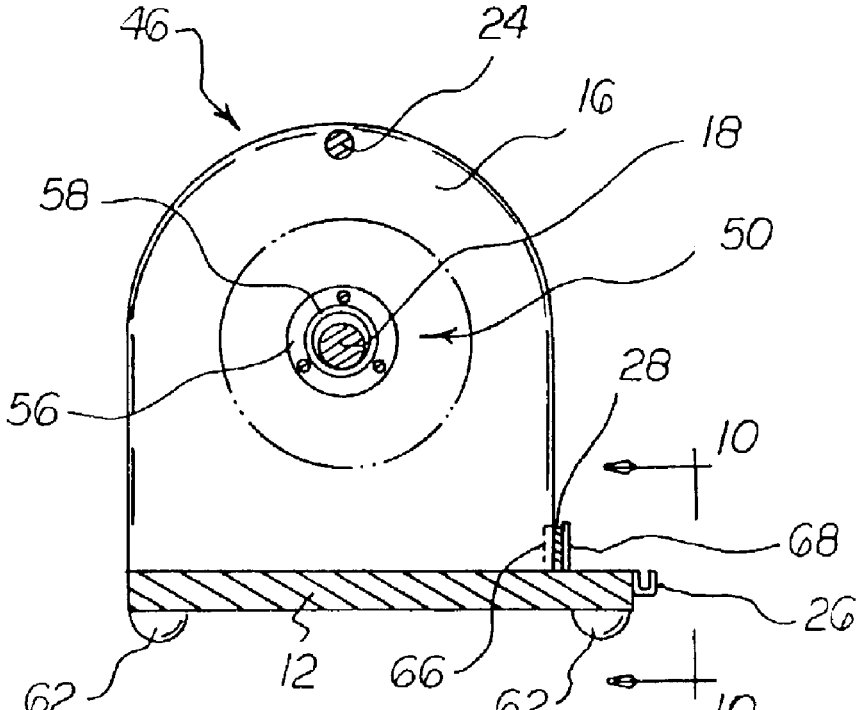
FIG 9

PORTABLE PAPER DISPENSER APPARATUS

CROSS-REFERENCE TO RELATED APPLICATION

This application claims priority based upon my now abandoned Provisional Application Ser. No. 60/390,105; filed Jun. 21, 2002.

BACKGROUND OF THE INVENTION

1. Field of the Invention

The present invention relates generally to dispensers of paper from a roll and, more particularly, to a paper dispenser especially adapted for cutting off sheets of paper from the roll.

2. Description of the Prior Art

Dispensing of paper from a roll of paper to obtain a sheet of paper is well known in the art. Throughout the years, a number of innovations have been developed relating to dispensing sheets of paper from a paper roll, and the following U.S. patents are representative of some of those innovations: U.S. Pat. Nos. 4,881,675, 6,003,668, 6,068,118, and 6,213,424. More specifically, U.S. Pat. No. 4,881,675 discloses a portable paper dispenser apparatus which has a top portion and a bottom portion. The paper that is dispensed is dispensed from the top portion of the apparatus. Once the paper is dispensed, if it is not immediately removed from the area, the paper can fall to the floor, and, in the process of falling, can become folded or crumpled. In this respect, it would be desirable if a portable paper dispenser apparatus were provided in which paper is dispensed near the floor to prevent crumpling or folding of the dispensed paper.

U.S. Pat. No. 6,003,668 discloses a portable paper dispenser apparatus which include two side handles, each one being located at a respective end of the apparatus. As a result, two hands are needed for carrying the apparatus. For convenience and efficiency in carrying a portable paper dispenser apparatus, it would be desirable if the apparatus included a single handle, extending longitudinally along the longitudinal axis of the apparatus, so that the apparatus can easily be carried with one hand.

U.S. Pat. No. 6,068,118 discloses a portable paper dispenser apparatus wherein the paper is toilet paper which is generally perforated along predetermined lines of paper sheet separation. No provision is made for use of a cutting implement for cutting the paper off of the roll. In many environments, the paper on the roll is not perforated, so it is necessary to use a cutting implement to cut a sheet of paper off of the roll. In this respect, it would be desirable if a portable paper dispenser apparatus were provided which included a guide for a cutting implement.

U.S. Pat. No. 6,213,424 discloses a towelette dispensing apparatus which includes an electric motor and a complex arrangement of rollers for guiding the paper off of the roll. For purposes of simplicity and economy, it would be desirable if a portable paper dispenser apparatus were provided which need not employ an electric motor and need not employ an arrangement of rollers for guiding the paper off of the roll.

U.S. Pat. No. 4,635,362 may be of interest for its disclosure of a cutting apparatus in which an cutting implement is used to cut a sheet of paper. It does not appear that this apparatus is used for cutting paper off of a roll.

Still other features would be desirable in a portable paper dispenser apparatus. The current method for a contractor to dispense paper is to roll it on the floor and cut it. This can be cumbersome, as the roll or paper has a tendency to roll around on the floor. In this respect, it would be desirable if a portable paper dispenser apparatus were provided that avoids the need for a contractor to roll paper on the floor and cut it on the floor. Moreover, when the roll of paper is cut by free hand, the cut isn't always straight. In this respect, it would be desirable if a portable paper dispenser apparatus were provided which has a cutting guide, thereby avoiding the need to cut paper by free hand. In addition, currently, the cutting edge of the knife can come into contact with the floor, or a person, thereby damaging the floor or injuring the person. In this respect, it would be desirable if a portable paper dispenser apparatus were provided which prevents the cutting knife from contacting the floor or a person when the paper is cut.

Often, when cutting paper, two implements are essential to be at hand: a cutting implement; and a tape measure for measuring the paper to be cut. In this respect, it would be desirable if a portable paper dispenser apparatus were provided which included provisions for carrying a cutting implement and a tape measure on the apparatus.

Currently, a contractor often employs loose rolls of paper on the floor. Such loose rolls of paper can roll around on the floor, causing a safety hazard. In this respect, it would be desirable if a portable paper dispenser apparatus were provided which prevents a roll of paper from rolling around on the floor.

Thus, while the foregoing body of prior art indicates it to be well known to use portable paper dispenser apparatuses, the prior art described above does not teach or suggest a portable paper dispenser apparatus which has the following combination of desirable features: (1) dispenses paper near the floor; (2) includes a single handle, extending longitudinally along the longitudinal axis of the apparatus, so that the apparatus can easily be carried with one hand; (3) includes a guide for a cutting implement; (4) does not need the use of an electric motor or an arrangement of rollers for guiding the paper off of the roll; (5) avoids the need for a contractor to roll paper on the floor and cut it on the floor; (6) has a cutting guide, thereby avoiding the need to cut paper by free hand; (7) prevents the cutting knife from contacting the floor or a person when the paper is cut; (8) includes provisions for carrying a cutting implement and a tape measure on the apparatus; and (9) prevents a roll of paper from rolling around on the floor.

The foregoing desired characteristics are provided by the unique portable paper dispenser apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a portable paper dispenser apparatus for dispensing a layer of paper from a roll of paper and includes a base member. A first side support is attached to a first end of the base member and projects upward therefrom. The first side support includes first support rod reception means. A second side support is attached to a second end of the base member and projects upward therefrom. The second side support includes second support rod reception means. A roll support rod is received in the first support rod reception means and the second support rod reception means, whereby the roll support rod is supported by the first side support and the second side support. A handle is connected between the first side support and the second side support. The handle is located above the roll support rod. A paper guide assembly extends from the first end to the second end of the base member. The paper guide assembly is positioned in front of the first side support and the second side support. A blade guide channel member is attached to the base member. The blade guide channel member extends from the first end to the second end of the base member. The blade guide channel member is positioned below the top surface of the base member, and the blade guide channel member is positioned in front of the paper guide assembly.

Preferably, the handle extends longitudinally from the first side support to the second side support.

In one embodiment of the invention, the first support rod reception means include a first support rod reception slot, and the second support rod reception means include a second support rod reception slot. The first support rod reception slot extends downward from an outer edge of the first side support to an inner portion of the first side support. The second support rod reception slot extends downward from an outer edge of the second side support to an inner portion of the second side support.

The paper guide assembly includes a hinge pin connected to the first side support, a paper guide member connected to the hinge pin, and guide member retention means for securing a free end of the paper guide member.

With one embodiment, the guide member retention means include a lock bolt at the second end of the base member, and a lock nut for attaching to the lock bolt.

With another embodiment, a free end of the paper guide member is ferromagnetic. In this respect, the guide member retention means include a magnet member retained in the second side support, and a guide post spaced away from the magnet member by a suitable distance permitting reception of the free end of the paper guide member therebetween.

A first leg is attached to the underside of the base member at the first end thereof, and a second leg is attached to the underside of the base member at the second end thereof.

In another embodiment, the first support rod reception means include a first support rod reception bracket, and the second support rod reception means include a second support rod reception bracket. The first support rod reception bracket includes a first base portion connected to the first side support, and a first rod-reception portion extends out from the first base portion. The second support rod reception bracket includes a second base portion connected to the second side support, and a second rod-reception portion extends out from the second base portion. The first rod-reception portion has an open top.

In another embodiment, the first leg includes a pair of first non-slip legs, and the second leg includes a pair of second non-slip legs.

In another embodiment, the handle includes an upwardly extending grasping portion.

Preferably, a first article reception bracket and a second article reception bracket are attached to one or the other of the first side support or the second side support. A cutting implement having a cutting implement blade is retained in the first article reception bracket when the cutting implement is not in use. A tape dispenser is retained in the second article reception bracket when the tape dispenser is not in use.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable paper dispenser apparatus which has all of the advantages of the prior art and none of the disadvantages.

It is another object of the present invention to provide a new and improved portable paper dispenser apparatus which may be easily and efficiently manufactured and marketed.

It is a further object of the present invention to provide a new and improved portable paper dispenser apparatus which is of durable and reliable construction.

An even further object of the present invention is to provide a new and improved portable paper dispenser apparatus which is susceptible of a low cost of manufacture with regard to both materials and labor, and which accordingly is then susceptible of low prices of sale to the consuming public, thereby making such portable paper dispenser apparatus available to the buying public.

Still yet a further object of the present invention is to provide a new and improved portable paper dispenser apparatus which dispenses paper near the floor.

Still another object of the present invention is to provide a new and improved portable paper dispenser apparatus that includes a single handle, extending longitudinally along the longitudinal axis of the apparatus, so that the apparatus can easily be carried with one hand.

Yet another object of the present invention is to provide a new and improved portable paper dispenser apparatus which includes a guide for a cutting implement.

Even another object of the present invention is to provide a new and improved portable paper dispenser apparatus that does not need the use of an electric motor or an arrangement of rollers for guiding the paper off of the roll.

Still a further object of the present invention is to provide a new and improved portable paper dispenser apparatus which avoids the need for a contractor to roll paper on the floor and cut it on the floor.

Yet another object of the present invention is to provide a new and improved portable paper dispenser apparatus that has a cutting guide, thereby avoiding the need to cut paper by free hand.

Still another object of the present invention is to provide a new and improved portable paper dispenser apparatus which prevents the cutting knife from contacting the floor or a person when the paper is cut.

Yet another object of the present invention is to provide a new and improved portable paper dispenser apparatus that includes provisions for carrying a cutting implement and a tape measure on the apparatus.

Still a further object of the present invention is to provide a new and improved portable paper dispenser apparatus that prevents a roll of paper from rolling around on the floor.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a front view showing a first embodiment of the portable paper dispenser apparatus of the invention, wherein a roll of paper is installed therein.

FIG. 2 is a side view of the embodiment of the portable paper dispenser apparatus shown in FIG. 1 taken along line 2—2 of FIG. 1.

FIG. 3 is a cross-sectional view of the embodiment of the portable paper dispenser apparatus of FIG. 1 taken along line 3—3 thereof.

FIG. 4 is an enlarged side view of the portion of the embodiment of the invention shown in FIG. 3 that is contained in circled region 4 thereof.

FIG. 6 is a front view showing a second embodiment of the portable paper dispenser apparatus of the invention, wherein a roll of paper is installed therein.

FIG. 7 is a side view of the embodiment of the portable paper dispenser apparatus shown in FIG. 7 taken along line 7—7 of FIG. 6.

FIG. 8 is a cross-sectional view of the embodiment shown in FIG. 6 taken along line 8—8 thereof.

FIG. 9 is a cross-sectional view of the embodiment shown in FIG. 6 taken along line 9—9 thereof.

DESCRIPTION OF THE PREFERRED EMBODIMENT

With reference to the drawings, a new and improved portable paper dispenser apparatus embodying the principles and concepts of the present invention will be described.

Figure 5:
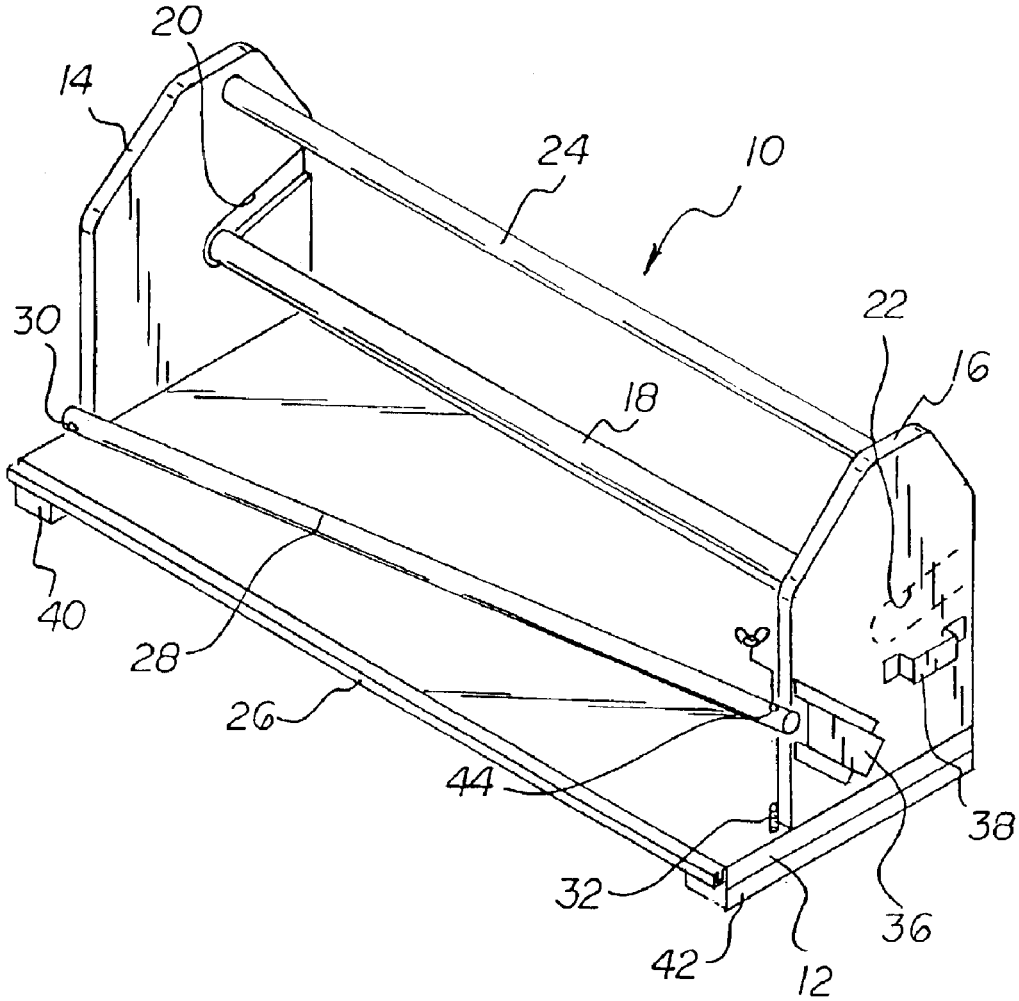
FIG. 5 is a partially exploded perspective view of the embodiment of the invention shown in FIGS. 1–4, with the roll of paper removed.

With respect to the embodiment of the invention shown in FIGS. 1–5, a portable paper dispenser apparatus 10 is provided for dispensing a layer of paper 13 from a roll of paper 11 and includes a base member 12. A first side support 14 is attached to a first end of the base member 12 and projects upward therefrom. The first side support 14 includes first support rod reception means. A second side support 16 is attached to a second end of the base member 12 and projects upward therefrom. The second side support 16 includes second support rod reception means. A roll support rod 18 is received in the first support rod reception means and the second support rod reception means, whereby the roll support rod 18 is supported by the first side support 14 and the second side support 16. A handle 24 is connected between the first side support 14 and the second side support 16. The handle 24 is located above the roll support rod 18. A paper guide assembly extends from the first end to the second end of the base member 12. The paper guide assembly is positioned in front of the first side support 14 and the second side support 16. A blade guide channel member 26 is attached to the base member 12. The blade guide channel member 26 extends from the first end to the second end of the base member 12. The blade guide channel member 26 is positioned below the top surface of the base member 12, and the blade guide channel member 26 is positioned in front of the paper guide assembly.

Preferably, the handle 24 extends longitudinally from the first side support 14 to the second side support 16.

With the embodiment of the invention shown in FIGS. 1–5, the first support rod reception means include a first support rod reception slot 20, and the second support rod reception means include a second support rod reception slot 22. The first support rod reception slot 20 extends downward from an outer edge of the first side support 14 to an inner portion of the first side support 14. The second support rod reception slot 22 extends downward from an outer edge of the second side support 16 to an inner portion of the second side support 16.

The paper guide assembly includes a hinge pin 30 connected to the first side support 14, a paper guide member 28 connected to the hinge pin 30, and guide member retention means for securing a free end of the paper guide member 28.

With the embodiment of the invention shown in FIGS. 1–5, the guide member retention means include a lock bolt 32 at the second end of the base member 12, and a lock nut 34 for attaching to the lock bolt 32.

Figure 10:
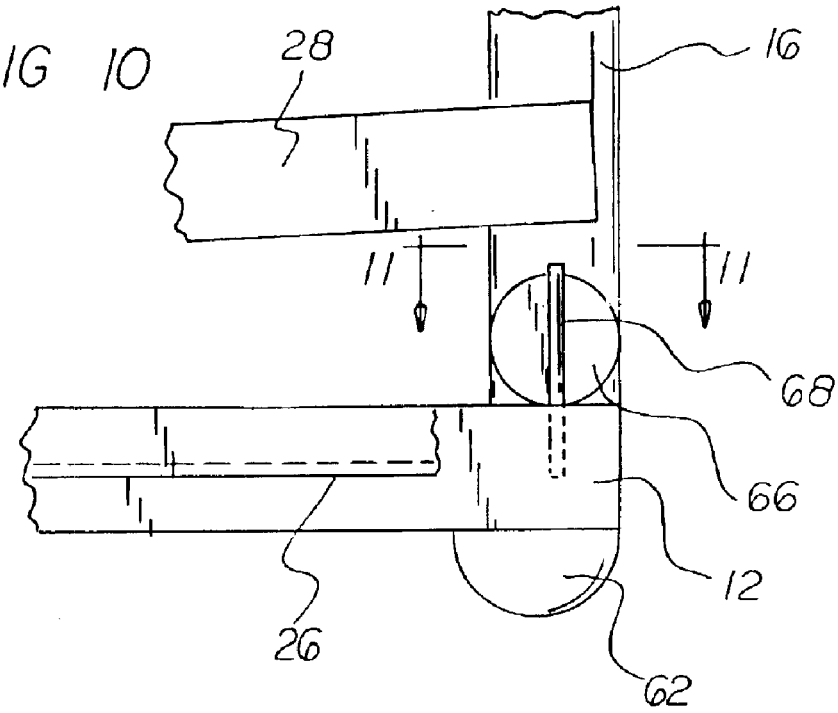
FIG. 10 is an enlarged partial front view of the embodiment of the invention shown in FIG. 9 taken along line 10—10 thereof.
Figure 11:
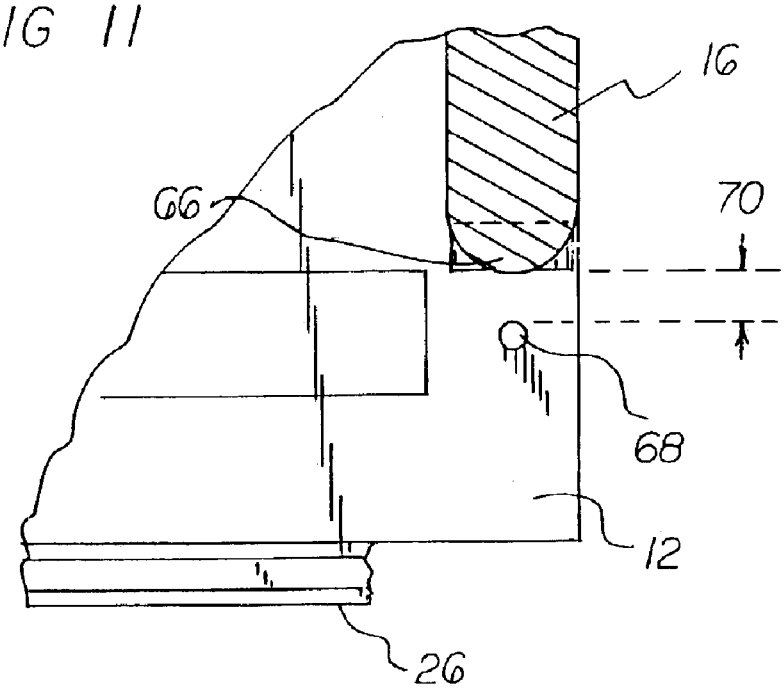
FIG. 11 is an enlarged partial cross-sectional view of the embodiment of the invention shown in FIG. 10 taken along line 11—11 thereof.

In contrast, with the embodiment of the invention shown in FIGS. 6–11, wherein a free end of the paper guide member 28 is ferromagnetic. The guide member retention means include a magnet member 66 retained in the second side support 16, and a guide post 68 spaced away from the magnet member 66 by a suitable distance 70 permitting reception of the free end of the paper guide member 28 therebetween.

To use the portable paper dispenser apparatus 10 of the invention shown in FIGS. 1–5, the roll support rod 18 is installed into the core of a roll of paper 11. Then, the roll of paper 11, containing the roll support rod 18 installed therein, is carried to the first side support 14 and the second side support 16 so that ends of the roll support rod 18 are received in the first support rod reception slot 20 and the second support rod reception slot 22. Then, the roll of paper 11 is released, and the ends of the roll support rod 18 slide down the first support rod reception slot 20 and the second support rod reception slot 22, respectively, until the respective ends of the rod reception slots are reached.

Then, a layer of paper 13 is unrolled from the roll of paper 11. The lock nut 34 is unscrewed from the lock bolt 32, and the paper guide member 28 is lifted upward around the hinge pin 30. Then, a portion of the layer of paper 13 is placed on the top surface of the base member 12, with a portion of the paper layer 13 extending past the location of the paper guide member 28. Then, the paper guide member 28 is lowered over the layer of paper 13, the lock bolt 32 is allowed to pass through a lock bolt reception channel 44 in the paper guide member 28, and the lock nut 34 is installed on the lock bolt 32. In this way, the paper guide member 28 is locked in a position above the layer of paper 13 without clamping down on the layer of paper 13.

Then, the free end of the layer of paper 13 is pulled in a direction away from the roll of paper 11 so that paper is dispensed from the roll of paper 11. As the layer of paper 13 is dispensed, the dispensed paper is threaded under the paper guide member 28, between the paper guide member 28 and the top of the base member 12.

The layer of paper 13 also passes over the blade guide channel member 26. The portion of paper to be cut off from the roll of paper 11 is passed beyond the blade guide channel member 26. For a measured piece of paper to be cut off of the roll of paper 11, the measurement is made on the paper from the blade guide channel member 26 out to a free end of the paper that is in front of the blade guide channel member 26.

To cut off a portion of paper 15 from the layer of paper 13, the layer of paper 13 is laid over the top of the blade guide channel member 26, as shown in FIGS. 2–4. Then, the utility knife 17 is handled by a user, and the utility knife blade 19 is caused to cut through the layer of paper 13. Then, the utility knife 17 is moved from the first end to the second end of the blade guide channel member 26, or vice versa, to as to cut the layer of paper 13 to provide a cut off portion of paper 15.

After the cut off portion of paper 15 is separated from the layer of paper 13, the leading edge of the layer of paper 13 is retained under the paper guide member 28. In this respect, the free end of the layer of paper 13 is ready to be grasped by a user to pull more paper off of the roll of paper 11 to be dispensed and cut.

The basic use of the embodiment of the invention shown in FIGS. 6–11, is very similar to the use of the embodiment of the invention shown in FIGS. 1–5, with the exceptions as noted below.

In using the embodiment of the invention shown in FIGS. 6–11, with the guide member retention means shown therein, when the paper guide member 28 is lowered around the hinge pin 30 to the base member 12, between the magnet member 66 and the guide post 68, the magnet member 66 attracts the free end of the paper guide member 28 and retains that free end against the magnet member 66.

As shown in the embodiment of the invention in FIGS. 1–5, first leg 40 is attached to the underside of the base member 12 at the first end thereof, and a second leg 42 is attached to the underside of the base member 12 at the second end thereof.

Further with respect to the embodiment of the invention shown in FIGS. 6–11, a second embodiment of the portable paper dispenser apparatus 46 is shown. Reference numerals are shown that correspond to like reference numerals that designate like elements shown in the other figures. In addition, the first support rod reception means include a first support rod reception bracket 48, and the second support rod reception means include a second support rod reception bracket 50.

The first support rod reception bracket 48 includes a first base portion 52 is connected to the first side support 14 and a first rod-reception portion 54 extending out from the first base portion 52. The second support rod reception bracket 50 includes a second base portion 56 is connected to the second side support 16 and a second rod-reception portion 58 extending out from the second base portion 56. The first rod-reception portion 54 has an open top.

To use the first support rod reception bracket 48 and the second support rod reception bracket 50, one end of the roll support rod 18 is placed in the second rod-reception portion 58. Then, the other end of the roll support rod 18 is passed through the open top of the first rod-reception portion 54 to rest on the bottom of the first rod-reception portion 54. The first leg includes a pair of first non-slip legs 60, and the second leg includes a pair of second non-slip legs 62.

The handle includes an upwardly extending grasping portion 64. The handle with the upwardly extending grasping portion 64 is built-in to the first side support 14 and the second side support 16 a first article reception bracket 36 and a second article reception bracket 38 attached to one or the other of the first side support 14 or the second side support 16.

A cutting implement 17 having a cutting implement blade 19 is retained in the first article reception bracket 36 when the cutting implement 17 is not in use. As shown in the drawings, the cutting implement 17 can be a utility knife 17. A tape dispenser 21 retained in the second article reception bracket 38 when the tape dispenser 21 is not in use.

For users in the fields of painting and construction, the roll of paper 11 includes painter and contractor construction paper. The paper can vary in diameter and widths. Although the portable paper dispenser apparatus 10 of the invention can be made in any suitable dimensions. A generally suitable apparatus is provided when the portable paper dispenser apparatus of the invention can be 38.5 inches wide, 9.25 inches deep at the base with 8.75 inches by 7.25 inches wide side supports. The legs can be 0.75 inches by 1.5 inches by 9.25 inches, and the legs are positioned under two ends of the base member 12. The aluminum blade guide channel member 26 can be located 1.25 inches in front of the paper guide member 28. The legs can be 0.75 inches by 1.5 inches by 9.25 inches, and the legs are positioned under two ends of the base member 12. In this respect, the portable paper dispenser apparatus of the invention can accommodate rolls of paper up to 6 inches in diameter and up to 36 inches in width. The portable paper dispenser apparatus of the invention can be constructed of wood, plastic pipe. An aluminum blade guide channel member 26. A galvanized steel handle, and a galvanized steel paper guide member 28.

As stated above, the current method for a contractor to dispense paper is to roll it on the floor and cut it. This can be cumbersome, as the roll or paper has a tendency to roll around on the floor. Moreover, when the roll of paper is cut by free hand, the cut isn't always straight. In addition, the cutting edge of the knife can come into contact with the floor, or a person, thereby damaging the floor or injuring the person. The portable paper dispenser apparatus of the invention can help the contractor in a number of ways. It eliminates the need for loose rolls of paper on the floor, thereby assuring that the roll of paper that is used will not roll around on the floor. Also, not leaving a roll of paper on the floor will reduce a safety hazard of a roll of paper that can be tripped over. It enables the contractor to easily carry a roll of paper and transport it to a desired location. It enables the making straight cuts and protects from cutting the base of the dispenser and floors, in a work environment, under the dispenser. It also reduces potential injuries to persons using a knife free hand. Also, with the presence of a tape measure. A utility knife, and a tape dispenser, all the tools needed to measure and cut the paper are readily at hand.

The components of the portable paper dispenser apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

In addition, it is apparent from the above that the present invention accomplishes all of the objects set forth by providing a new and improved portable paper dispenser apparatus that is low in cost, relatively simple in design and operation, and which may advantageously be used to dispense paper near the floor. With the invention, a portable paper dispenser apparatus is provided which includes a single handle, extending longitudinally along the longitudinal axis of the apparatus, so that the apparatus can easily be carried with one hand. With the invention, a portable paper dispenser apparatus is provided which includes a guide for a cutting implement. With the invention, a portable paper dispenser apparatus is provided which does not need the use of an electric motor or an arrangement of rollers for guiding the paper off of the roll.

In addition, with the invention, a portable paper dispenser apparatus is provided which avoids the need for a contractor to roll paper on the floor and cut it on the floor. With the invention, a portable paper dispenser apparatus is provided which has a cutting guide, thereby avoiding the need to cut paper by free hand. With the invention, a portable paper dispenser apparatus is provided which prevents the cutting knife from contacting the floor or a person when the paper is cut. With the invention, a portable paper dispenser apparatus is provided which includes provisions for carrying a cutting implement and a tape measure on the apparatus. With the invention, a portable paper dispenser apparatus is provided which prevents a roll of paper from rolling around on the floor.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

What is claimed as being new and desired to be protected by Letters Patent of the United States is as follows:

1. A portable paper dispenser apparatus for dispensing a layer of paper from a roll of paper, comprising:

a base member, a first side support attached to a first end of said base member and projecting upward therefrom, wherein said first side support includes first support rod reception means, a second side support attached to a second end of said base member and projecting upward therefrom, wherein said second side support includes second support rod reception means, a roll support rod received in said first support rod reception means and said second support rod reception means, whereby said roll support rod may be supported by said first side support and said second side support, a handle connected between said first side support and said second side support, wherein said handle is located above said roll support rod, a paper guide assembly extending from said first end to said second end of said base member, wherein said paper guide assembly is positioned in front of said first side support and said second side support, and a blade guide channel member attached to said base member, wherein said blade guide channel member extends from said first end to said second end of said base member, wherein said blade guide channel member is positioned below the top surface of said base member, and wherein said blade guide channel member is positioned in front of said paper guide assembly.

2. The apparatus of claim 1 wherein said handle extends longitudinally from said first side support to said second side support.

3. The apparatus of claim 1 wherein:

said first support rod reception means include a first support rod reception slot, and said second support rod reception means include a second support rod reception slot.

4. The apparatus of claim 3 wherein said first support rod reception slot extends downward from an outer edge of said first side support to an inner portion of said first side support.

5. The apparatus of claim 3 wherein said second support rod reception slot extends downward from an outer edge of said second side support to an inner portion of said second side support.

6. The apparatus of claim 1 wherein said paper guide assembly includes:

a hinge pin connected to said first side support, a paper guide member connected to said hinge pin, and guide member retention means for securing a free end of said paper guide member.

7. The apparatus of claim 6 wherein said guide member retention means include:

a lock bolt at said second end of said base member, and a lock nut for attaching to said lock bolt.

8. The apparatus of claim 6 wherein:

a free end of said paper guide member is ferromagnetic.

9. The apparatus of claim 8 wherein said guide member retention means include:

a magnet member retained in said second side support, and a guide post spaced away from said magnet member by a suitable distance permitting reception of said free end of said paper guide member therebetween.

10. The apparatus of claim 1, further including:

a first leg attached to the underside of said base member at said first end thereof, and a second leg attached to said underside of said base member at said second end thereof.

11. The apparatus of claim 1 wherein:

said first support rod reception means include a first support rod reception bracket, and said second support rod reception means include a second support rod reception bracket.

12. The apparatus of claim 11 wherein said first support rod reception bracket includes a first base portion connected to said first side support and a first rod-reception portion extending out from said first base portion.

13. The apparatus of claim 12 wherein said first rod-reception portion has an open top.

14. The apparatus of claim 11 wherein said second support rod reception bracket includes a second base portion connected to said second side support and a second rod-reception portion extending out from said second base portion.

15. The apparatus of claim 1, further including:

a pair of first non-slip legs attached to the underside of said base member at said first end thereof, and a pair of second non-slip legs attached to said underside of said base member at said second end thereof.

16. The apparatus of claim 1 wherein said handle includes an upwardly extending grasping portion.

17. The apparatus of claim 1, further including:

a first article reception bracket and a second article reception bracket attached to one or the other of said first side support or said second side support.

18. The apparatus of claim 17, further including:

a cutting implement having a cutting implement blade retained in said first article reception bracket when said cutting implement is not in use.

19. The apparatus of claim 17, further including:

a tape dispenser retained in said second article reception bracket when said tape dispenser is not in use.

* * * * *